US007546061B2

(12) United States Patent
Kurokawa et al.

(10) Patent No.: US 7,546,061 B2
(45) Date of Patent: Jun. 9, 2009

(54) IMAGE FORMING DEVICE

(75) Inventors: Yasuhiro Kurokawa, Saitama (JP); Toshimitsu Kobayashi, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 11/607,955

(22) Filed: Dec. 4, 2006

(65) Prior Publication Data

US 2007/0251405 A1 Nov. 1, 2007

(30) Foreign Application Priority Data

Apr. 28, 2006 (JP) ..... 2006-126169

(51) Int. Cl.
*G03G 15/00* (2006.01)
*B41F 17/00* (2006.01)

(52) U.S. Cl. ..... 399/107; 101/494; 399/393

(58) Field of Classification Search ..... 399/107, 399/393; 101/494
See application file for complete search history.

(56) References Cited

U.S. PATENT DOCUMENTS

2007/0122184 A1* 5/2007 Syring et al. ..... 399/107

FOREIGN PATENT DOCUMENTS

JP 2000-137542 A 5/2000
JP 2004-75293 A 3/2004

OTHER PUBLICATIONS

First Notification of Office Action, dated Mar. 27, 2009, issued in corresponding CN Application No. 200410096344.7, 9 pages in English and Chinese.

* cited by examiner

*Primary Examiner*—David M Gray
*Assistant Examiner*—Erika Villaluna
(74) *Attorney, Agent, or Firm*—Sughrue Mion, PLLC

(57) ABSTRACT

An image forming device has: a cassette that accommodates a recording medium and that can be pulled out from a front surface of a device main body; and a lock unit locking the cassette to a rear surface of the device main body. The lock unit may have: a lock hole formed in a peripheral wall of the cassette; a bracket mounted to a rear surface side of the device main body; a lock having a rod, that passes through a hole formed in the bracket and that is inserted in the lock hole, and a hook, that is formed at the rod and that hooks on the lock hole; and a wire connecting the lock and a heavy object.

7 Claims, 14 Drawing Sheets

IMAGE FORMING DEVICE

BACKGROUND

1. Technical Field

The present invention relates to an image forming device which records images on recording media accommodated in an accommodating section.

2. Related Art

In recent years, there have been thefts of not only special sheets for securities and the like, but also of regular paper and the like which is used in offices, stores, schools, public facilities, and the like. There is the need for measures for preventing theft of sheets which are accommodated not only in devices which handle special sheets, but also in printers which have come into general use and the like.

Preventing the theft of sheets is aimed for by attaching a lock device to a sheet feed tray. However, because the lock device is attached to the front surface (the operating surface side) of the device main body so that a key can easily be used thereat, the appearance of the front surface of the device is marred. Further, when a lock device is attached within the device main body, the device main body must be remodeled greatly in order to ensure space for installation of the lock device.

SUMMARY

In consideration of the above circumstances, the present invention provides an image forming device.

According to a first aspect of the present invention, there is provided an image forming device comprising a cassette that can be pulled out from a front surface of a device main body, and that accommodates a recording medium; and a lock unit locking the cassette to a rear surface of the device main body.

BRIEF DESCRIPTION OF THE DRAWINGS

Exemplary embodiments of the present invention will be described in detail based on the following figures, wherein.

DETAILED DESCRIPTION

An image forming device 10 relating to a first exemplary embodiment of the image forming device of the present invention will be described.

Figure 1:
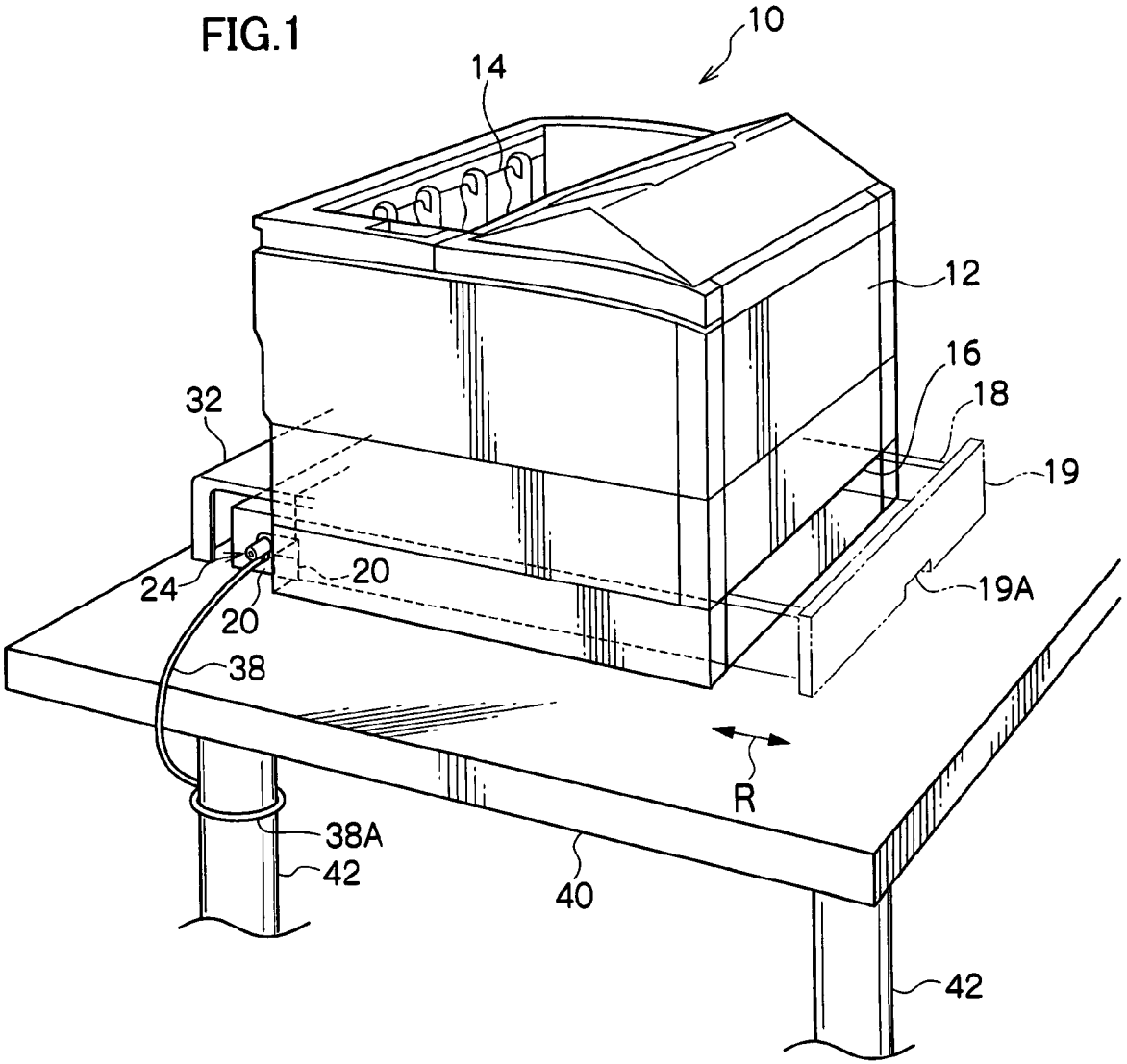
FIG. 1 is a perspective view showing the structure of an image forming device of a first exemplary embodiment.

As shown in FIG. 1, a sheet feed cassette 18 is disposed at the lower portion of the front surface of a main body frame 12 of the image forming device 10. Recording sheets are accommodated in the sheet feed cassette 18. The recording sheet which is fed-out from the sheet feed cassette 18 is conveyed by an unillustrated conveying unit, and an image is formed thereon at an unillustrated image forming section within the image forming device 10. Then, the recording sheet on which an image is formed is discharged-out from a discharging section 14 at the upper portion of the main body frame 12.

The sheet feed cassette 18 is formed in the shape of a box in which the recording sheets can be accommodated, and can be pulled out in the direction of arrow R from a sheet feed opening 16 formed in the main body frame 12. A front panel 19, which is of a size which can close the sheet feed opening 16, is provided at the front surface (the pull-out surface) of the sheet feed cassette 18. A finger-hooking portion 19A is formed at the lower portion of the front panel 19. When recording sheets are to be supplied into the sheet feed cassette 18, the user hooks the finger-hooking portion 19A with his/her hand (finger(s)), and simply pulls the sheet feed cassette 18 out in the direction of arrow R (forward) from the main body frame 12.

Figure 2:
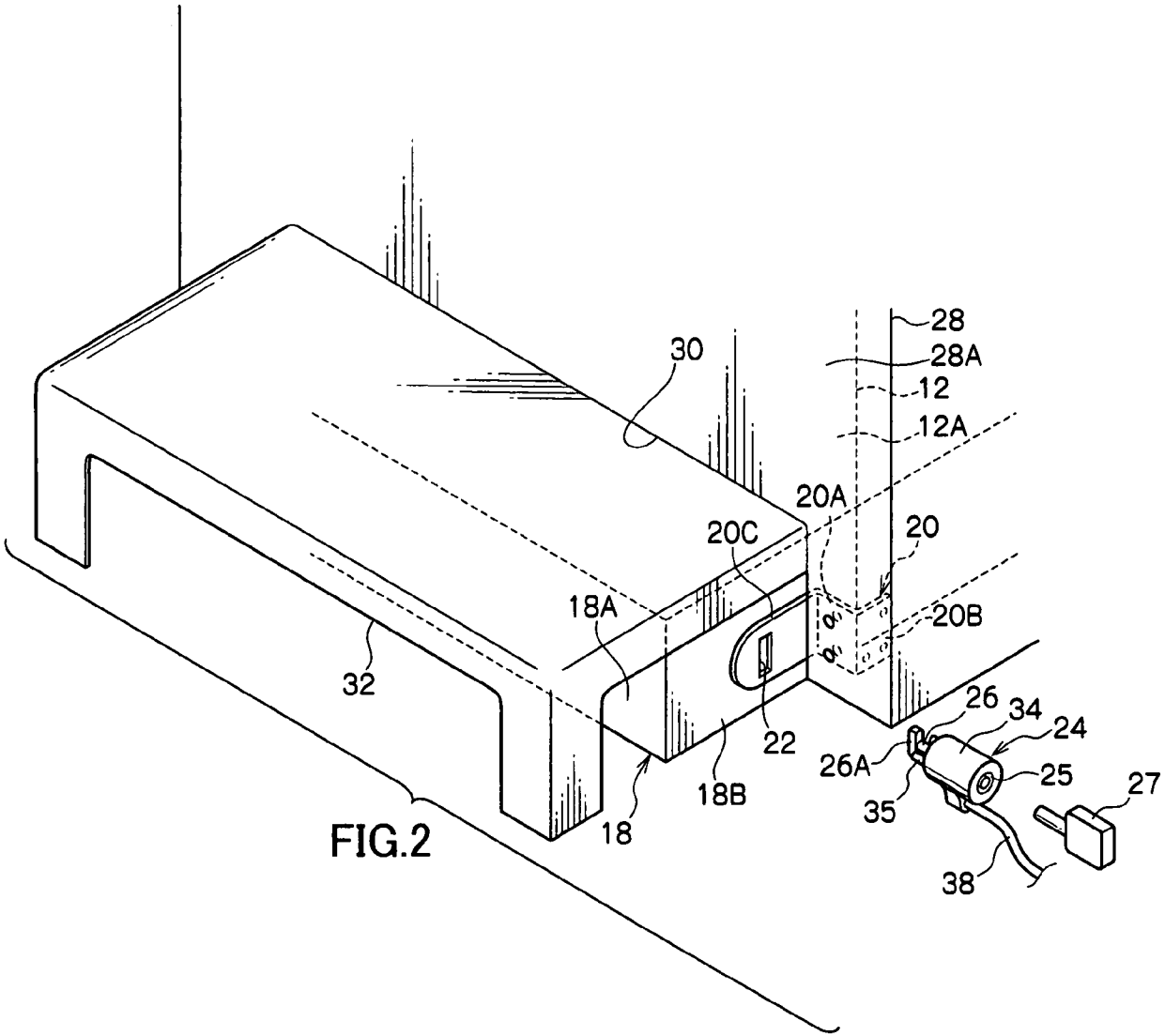
FIG. 2 is a perspective view viewing the image forming device of the first exemplary embodiment from the rear surface side thereof.

The size of the sheet feed cassette 18 in the longitudinal direction (the side along the sheet feeding direction) is structured to be longer than the size of the main body frame 12 in the longitudinal direction (the front-rear direction). Therefore, when the sheet feed cassette 18 is installed in the main body frame 12, as shown in FIG. 2, a back wall 18A of the sheet feed cassette 18 projects-out further than a rear surface 12A of the main body frame 12. In this way, when the sheet feed cassette 18 is installed in the main body frame 12, a space is formed between the rear surface 12A of the main body frame 12 and a side wall 18B of the sheet feed cassette 18.

A bracket 20 is mounted to the main body frame 12. The bracket 20 is structured by: a central piece 20A which is screwed to the rear surface 12A of the main body frame 12; a right piece 20B which extends orthogonally from one end portion of the central piece 20A, and is screwed to a side surface 12B of the main body frame 12; and a left piece 20C which extends from the other end portion of the central piece 20A in the direction opposite the direction in which the right piece 20B extends, and which is also provided at the side wall 18B of the sheet feed cassette 18.

Figure 3B:
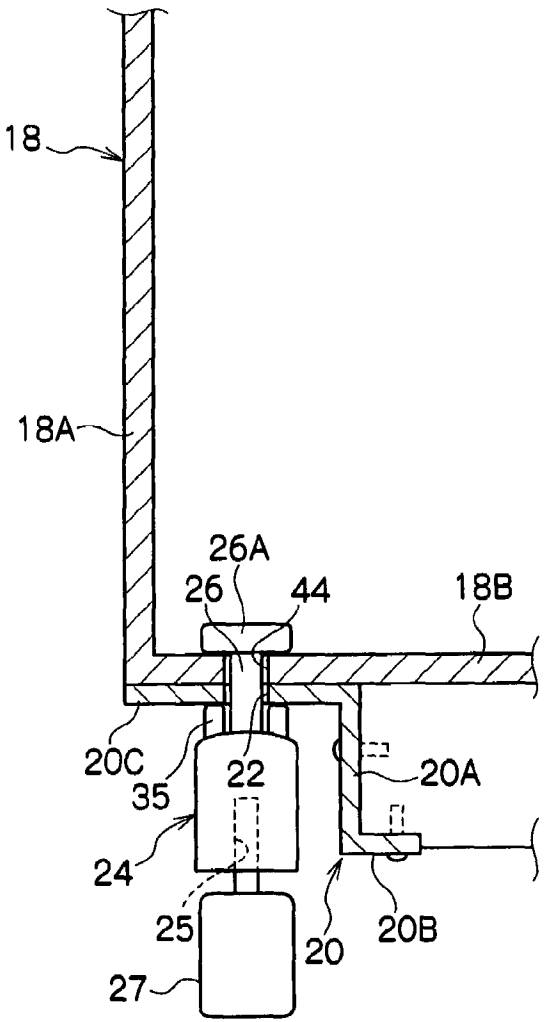
FIGS. 3A and 3B are top views of the image forming device of the first exemplary embodiment.
Figure 3A:
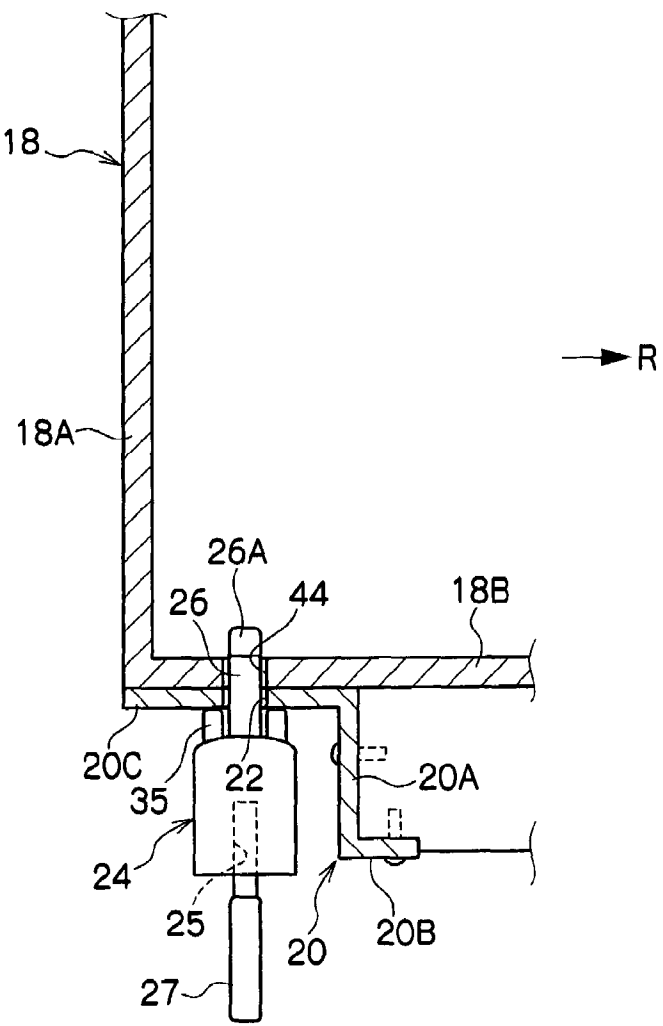

Partial sectional views of the image forming device 10 as viewed from above are shown in FIGS. 3A and 3B. As shown in FIG. 3A, a lock 24 which will be described later is attached to the left piece 20C of the bracket 20. A rod 26 of the lock 24 is inserted through a hole 22 which is circular and which is formed in the left piece 20C.

On the other hand, a lock hole 44, which is round and is substantially the same size as the hole 22 formed in the left piece 20C, is formed in the side wall 18B of the sheet feed cassette 18 at a position corresponding to the hole 22 of the left piece 20C of the bracket 20. The rod 26 of the lock 24, which is inserted through the hole 22 of the left piece 20C of the bracket 20, can be inserted through the lock hole 44. Note that the rod which is inserted through the lock hole 44 does not interfere with the recording sheets within the sheet feed cassette 18.

As shown in FIG. 2, the main body frame 12 is covered by a main body cover 28. An opening 30, which is of a size such that the sheet feed cassette 18 can be exposed, is formed in the substantially central portion of a rear surface 28A of the main body cover 28. When the sheet feed cassette 18 is installed in the main body frame 12, the rear wall side of the sheet feed cassette 18 is exposed from the opening 30.

A cover 32 is mounted to the opening 30. The sheet feed cassette 18 which projects-out from the main body frame 12 is covered by the cover 32, such that the recording sheets within the sheet feed cassette 18 are protected from dust and moisture.

As mentioned above, the lock 24 is attached to the left piece 20C of the bracket 20. The lock 24 has a head portion 34 which is shaped as a cylindrical tube. A hook 26A is formed integrally with the distal end of the rod 26 which projects-out from one end surface of the head portion 34.

A keyhole 25 is formed at the other end surface of the head portion 34. A key 27 is inserted into the keyhole 25, and the rod 26 is rotated by rotational operation of the key 27.

In accordance with this structure, as shown in FIG. 3A, when the rod 26 of the lock 24 is inserted through the lock hole 44 formed in the side wall 18B of the sheet feed cassette 18 and through the hole 22 formed in the left piece 20C of the bracket 20, and the key 27 inserted in the keyhole 25 is rotated and the rod 26 is rotated, as shown in FIG. 3B, the hook 26A abuts the inner wall of the side wall 18B, and the rod 26 becomes unable to be pulled out from the lock hole 44. At this time, the side wall 18B of the sheet feed cassette 18 and the left piece 20C of the bracket 20 are nipped between the hook 26A of the rod 26 and a cylindrical convex piece 35 formed at the periphery of the rod 26 at the head portion 34, and the lock 24 does not rotate with respect to the sheet feed cassette 18 and the bracket 20.

In this way, movement of the sheet feed cassette 18 in the direction of arrow R is impeded, and the sheet feed cassette 18 is in a state of being fixed to the left piece 20C of the bracket 20. Namely, the sheet feed cassette 18 is locked by the lock 24, and cannot be pulled out from the main body frame 12.

Note that the lock 24 does not get in the way because it is attached to the left piece 20C of the bracket 20 and is positioned in the space formed between the rear surface 12A of the main body frame 12 and the side wall 18B of the sheet feed cassette 18.

On the other hand, as shown in FIGS. 1 and 2, a wire 38 is connected to the side surface of the head portion 34 of the lock 24. A loop 38A is formed at the distal end of the wire 38. A leg 42 of a table 40 on which the image forming device 10 is placed can be inserted through the loop 38A.

In this way, the sheet feed cassette 18 is locked to the main body frame 12 by the lock 24, and theft of the recording sheets within the sheet feed cassette 18 is prevented. Further, the image forming device 10 is connected to the table 40 by the wire 38, and theft of the image forming device 10 main body also is prevented.

Operation of the first exemplary embodiment of the present invention will be described next.

At times such as when the image forming device 10 is not being driven or the like, the lock 24 is attached to the rear surface side of the main body frame 12, and the sheet feed cassette 18 is locked so as to be unable to be pulled out from the main body frame 12. Theft of the recording sheets within the sheet feed cassette 18 can thereby be prevented.

By disposing the lock 24 at the rear surface 12A side of the main body frame 12 in this way, the design of the front surface of the image forming device 10 is not marred. Further, because the lock 24 is at the rear surface 12A side of the main body frame 12, if a thief attempts to pull the sheet feed cassette 18 out from the main body frame 12, the thief will not be able to understand right away why the sheet feed cassette 18 cannot be pulled out. Therefore, the possibility that the thief will abandon the crime increases.

Further, in order to lock the sheet feed cassette 18 to the main body frame 12, a structure is employed in which the rod 26 of the lock 24, which is provided at the outer side of the main body frame 12, is inserted in the lock hole 44 which is formed in the side wall 18B of the sheet feed cassette 18. In this way, there is no need to ensure space for installation of the lock 24 within the main body frame 12. Therefore, the main body frame 12 does not become larger than necessary. Moreover, the lock 24 can be easily installed afterward even at an image forming device which does not have a unit which locks the sheet feed cassette 18 to the interior of the main body frame 12.

The lock hole 44, through which the rod 26 of the lock 24 is inserted, is provided in the side wall 18B of the sheet feed cassette 18 which projects-out from the rear surface 12A of the main body frame 12 when the sheet feed cassette 18 is accommodated in the main body frame 12. The sheet feed cassette 18 can thereby be locked to the main body frame 12 merely by inserting-in the rod 26 of the lock 24 in the direction orthogonal to the direction of pulling-out the sheet feed cassette 18.

The present exemplary embodiment is structured such that theft of the image forming device 10 is prevented by connecting the wire 38 to the lock 24 and inserting the leg 42 of the table 40, on which the image forming device 10 is placed, through the loop 38A at the distal end of the wire 38. However, it is not absolutely necessary to connect the wire 38 to the table 40 on which the image forming device 10 is placed. The image forming device 10 can be made to be difficult to move and theft thereof can be prevented by connecting the wire 38 to a member which is heavy.

Note that, by removing the lock 24 from the main body frame 12, the sheet feed cassette 18 can be made able to be pulled out. Namely, the sheet feed cassette 18 is made to be able to be pulled out from the main body frame 12 in the direction of arrow R, and recording sheets can be replenished into the sheet feed cassette 18, or work for eliminating a jam can be carried out, or the like.

The present exemplary embodiment is structured such that the bracket 20 is fixed to the main body frame 12 by being screwed to the rear surface 12A and the side surface 12B of the main body frame 12. However, it is not absolutely necessary to use a bracket of a configuration which is fixed at two places which are the rear surface 12A and the side surface 12B of the main body frame 12. For example, by using an L-shaped bracket, one piece of the bracket may be screwed to only the rear surface 12A.

Further, the present exemplary embodiment is structured such that the lock 24 is attached to the bracket 20, the bracket 20 and the sheet feed cassette 18 are fixed by the lock 24, and the sheet feed cassette 18 is locked to the main body frame 12. However, it is not absolutely necessary to attach the lock 24 to the bracket 20. A structure may be used in which a lock is attached to the lock hole 44 formed in the side wall 18B of the sheet feed cassette 18, and when an attempt is made to pull the sheet feed cassette 18 out, pulling-out of the sheet feed cassette 18 from the main body frame 12 is impeded due to the head portion of the lock catching on the main body frame.

The lock is not limited to the rod-type (cylinder-type) lock of the present exemplary embodiment, and a padlock may be used provided that it is attached to the lock hole 44 formed in the sheet feed cassette 18. Further, the rod 26 of the lock 24 may be inserted through a screw hole, and not inserted through the lock hole 44. Moreover, description has been given by using the lock 24 of a type which is locked by the key 27, but a lock of a type which is locked by dialing may be used.

There are cases in which the cover 32 which covers the sheet feed cassette 18 is structured so as to be able to be easily removed from the main body cover 28. In such cases, if the sheet feed cassette 18 and the cover 32 are both locked by a lock, it is not possible to remove the cover 32 and take the recording sheets in the sheet feed cassette 18 out from the rear surface of the main body frame 12.

An image forming device 50 relating to a second exemplary embodiment of the present invention will be described next. Note that description of portions which are similar to the first exemplary embodiment will be omitted.

Figure 4:
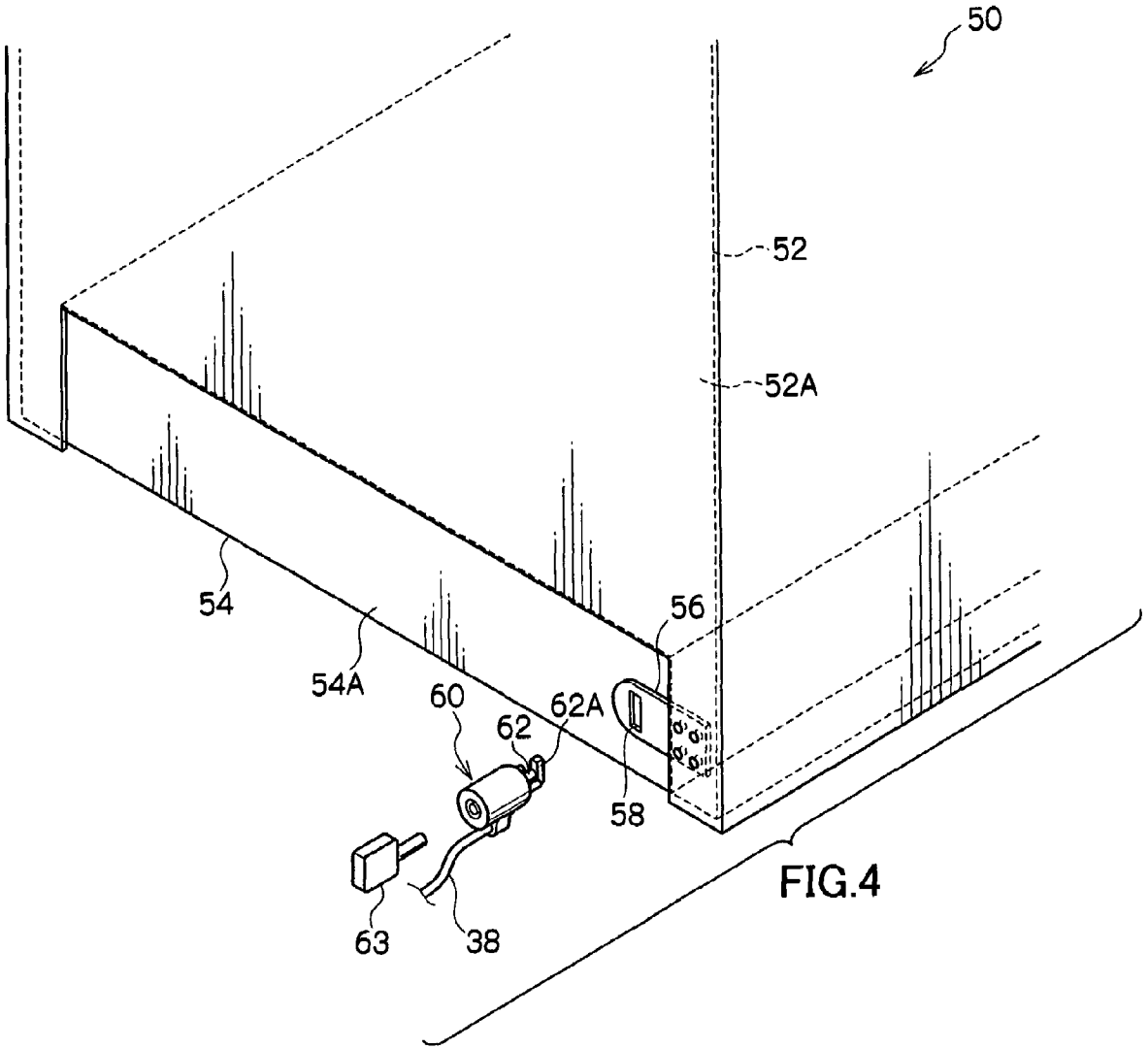
FIG. 4 is a perspective view viewing an image forming device of a second exemplary embodiment from the rear surface side thereof.

As shown in FIG. 4, the size of a sheet feed cassette 54 in the longitudinal direction (the side along the sheet feeding direction) is substantially the same length as the longitudinal direction size of a main body frame 52. Therefore, when the sheet feed cassette 54 is installed in the main body frame 52, a back wall 54A of the sheet feed cassette 54 is positioned substantially in the same plane as a rear surface 52A of the main body frame 52.

Figure 5B:
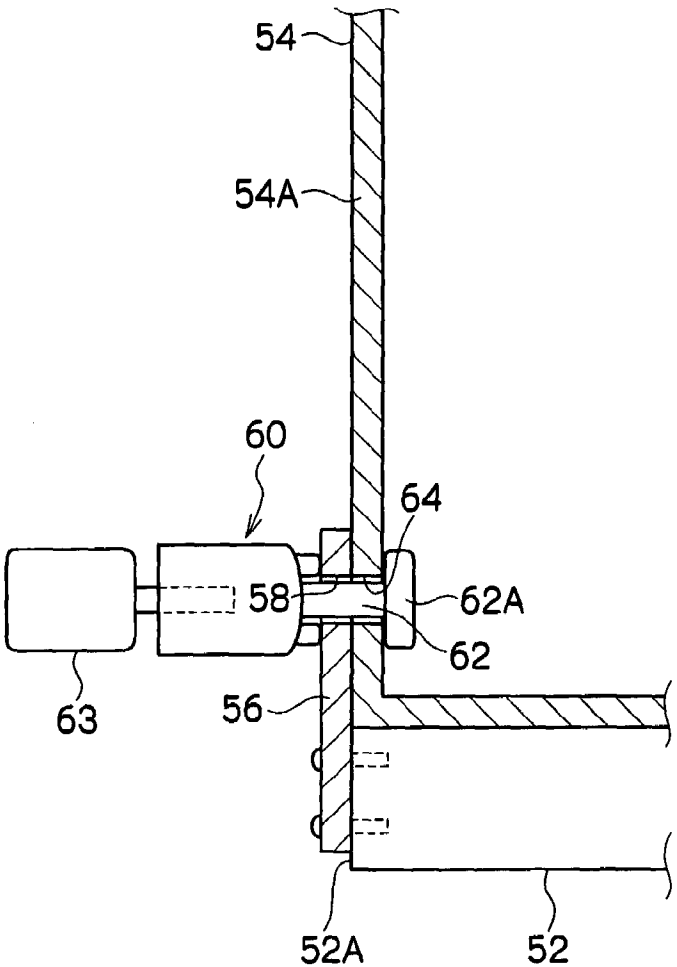
FIGS. 5A and 5B are top views of the image forming device of the second exemplary embodiment.
Figure 5A:
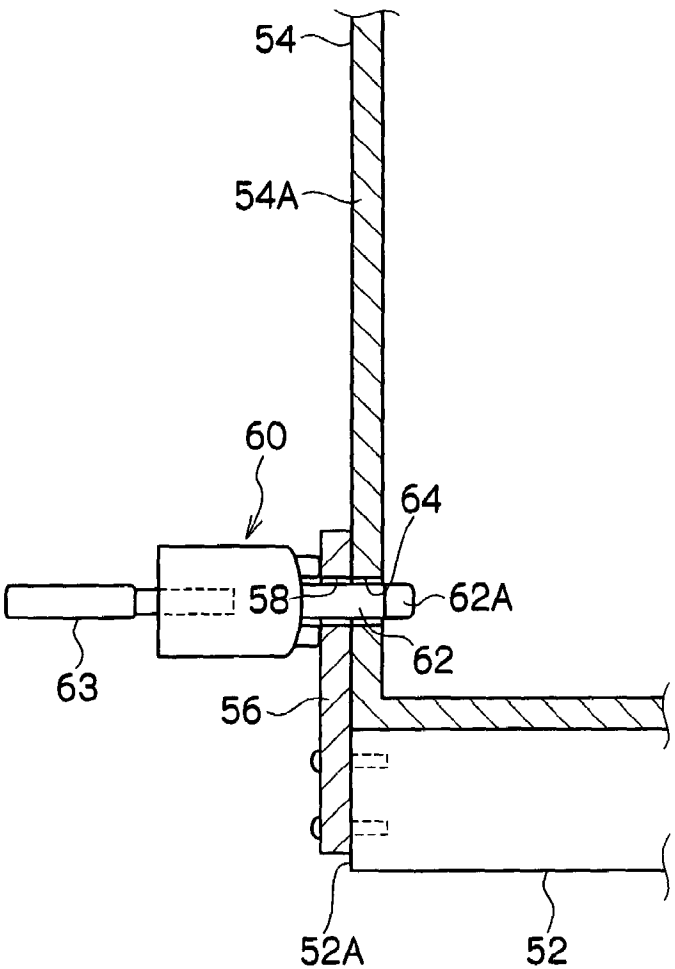

One end portion of a rectangular bracket 56 is screwed to the rear surface 52A of the main body frame 52. The other end portion of the bracket 56 is positioned at the back wall 54A side of the sheet feed cassette 54, and a hole 58 is formed therein. A rod 62 of a lock 60 is inserted in the hole 58. As shown in FIG. 5A, the rod 62 of the lock 60 which is inserted in the hole 58 is inserted through a lock hole 64 formed in the back wall 54A of the sheet feed cassette 54.

A hook 62A is provided at one longish direction end portion of the rod 62 of the lock 60. When the rod 62 is inserted into the sheet feed cassette 54, and the rod 62 is rotated by 90° by the rotational operation of a key 63, as shown in FIG. 5B, the hook 62A also rotates 90° and abuts the inner wall of the back wall 54A, and the rod 62 cannot be pulled out from the lock hole 64.

Due to such a structure, the back wall 54A of the sheet feed cassette 54 is in a state of being fixed to the bracket 56 by the lock 60. Namely, because the sheet feed cassette 54 is locked to the main body frame 52 at the lock 60, the sheet feed cassette 54 cannot be pulled out from the main body frame 52.

In a case in which the back wall 54A of the sheet feed cassette 54 and the rear surface 52A of the main body frame 52 are positioned substantially in the same plane in this way, the bracket 56 for fixing the sheet feed cassette 54 to the main body frame 52 can be made to be plate-shaped. Namely, the shape of the bracket 56 is not complex.

An image forming device 68 relating to a third exemplary embodiment of the present invention will be described next. Note that description of portions which are similar to the first exemplary embodiment will be omitted.

Figure 6:
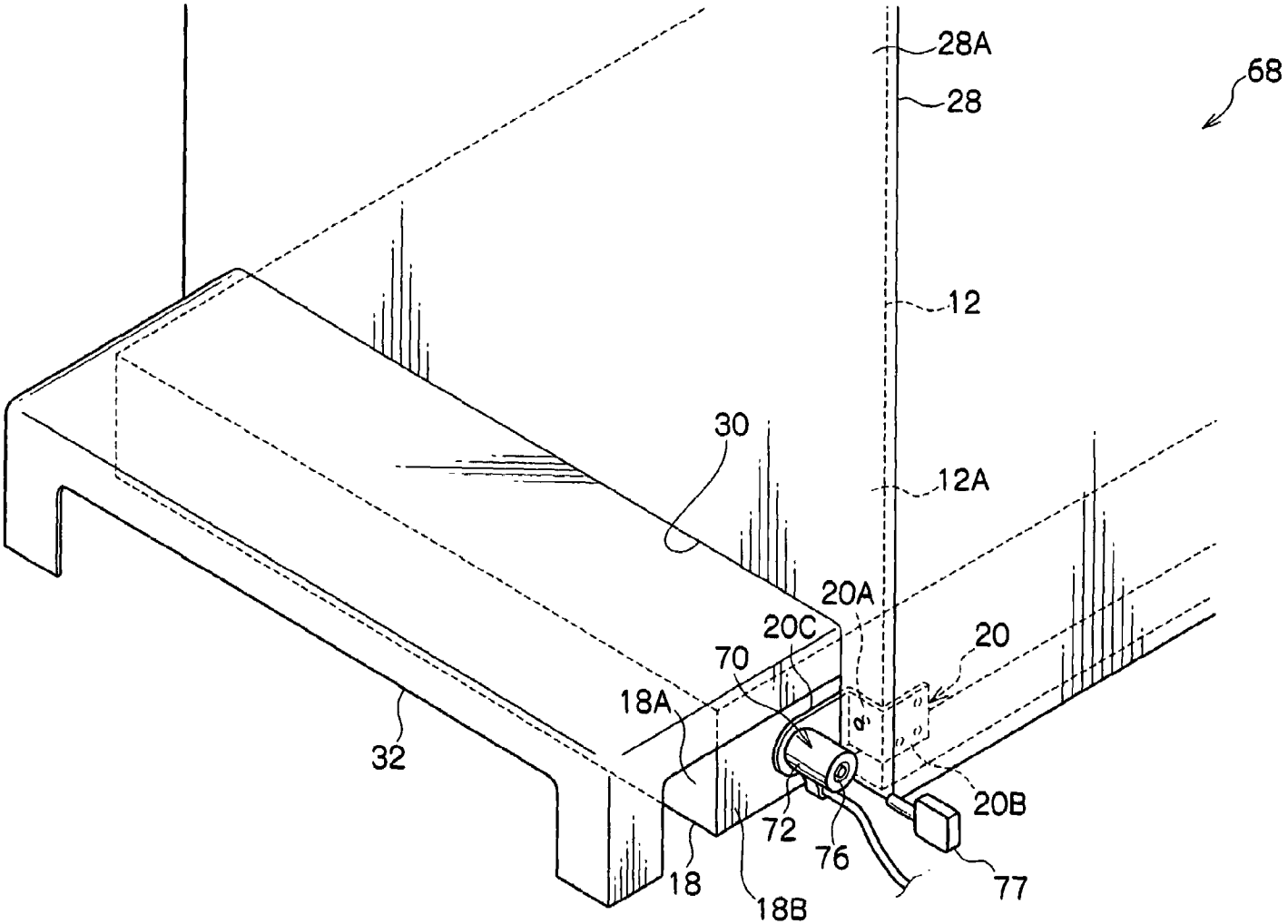
FIG. 6 is a perspective view viewing an image forming device of a third exemplary embodiment from the rear surface side thereof.

As shown in FIGS. 6 and 7, a lock 70 is attached to the left piece 20C of the bracket 20. The lock 70 has a cylindrical-tube-shaped head portion 72. One end surface of the head portion 72 is fixed by screws 23 to the left piece 20C of the bracket 20.

Figure 7B:
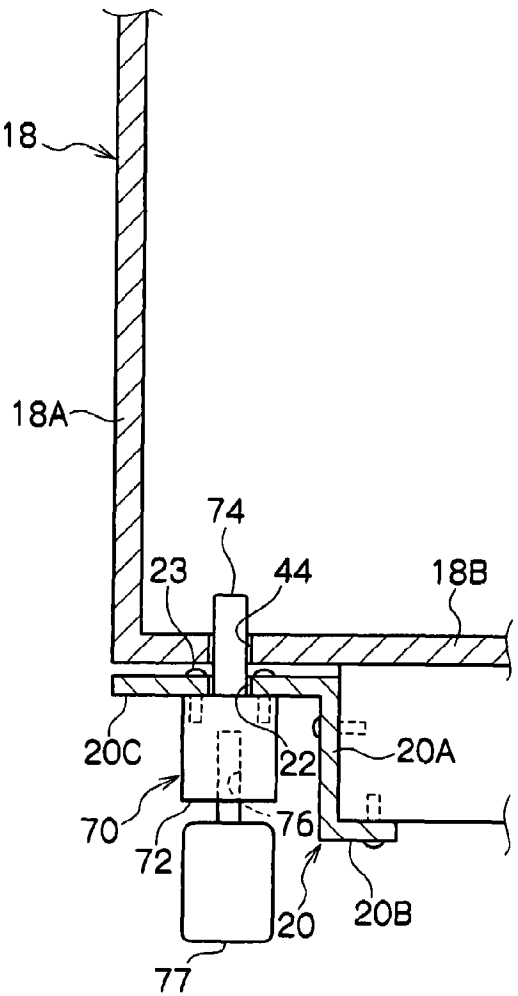
FIGS. 7A and 7B are top views of the image forming device of the third exemplary embodiment.

A rod 74 is accommodated within the head portion 72 in a state in which it can project-out from the one end surface of the head portion 72. A keyhole 76 is formed in the other end surface of the head portion 72. A key 77 is inserted in the keyhole 76. Due to rotational operation of the key 77, as shown in FIG. 7B, the rod 74 which is accommodated within the head portion 72 projects-out from the head portion 72.

At this time, the rod 74 which projects-out from the head portion 72 is inserted through the hole 22 formed in the left piece 20C of the bracket 20 and the lock hole 44 formed in the sheet feed cassette 18, and enters into the interior of the sheet feed cassette 18 which is accommodated in the main body frame 12.

In this way, movement of the sheet feed cassette 18 in the direction of arrow R is impeded, and the sheet feed cassette 18 is in a state of being fixed to the left piece 20C of the bracket 20. Namely, the sheet feed cassette 18 is locked by the lock 70, and cannot be pulled out from the main body frame 12.

Operation of the third exemplary embodiment of the present invention will be described next.

Figure 7A:
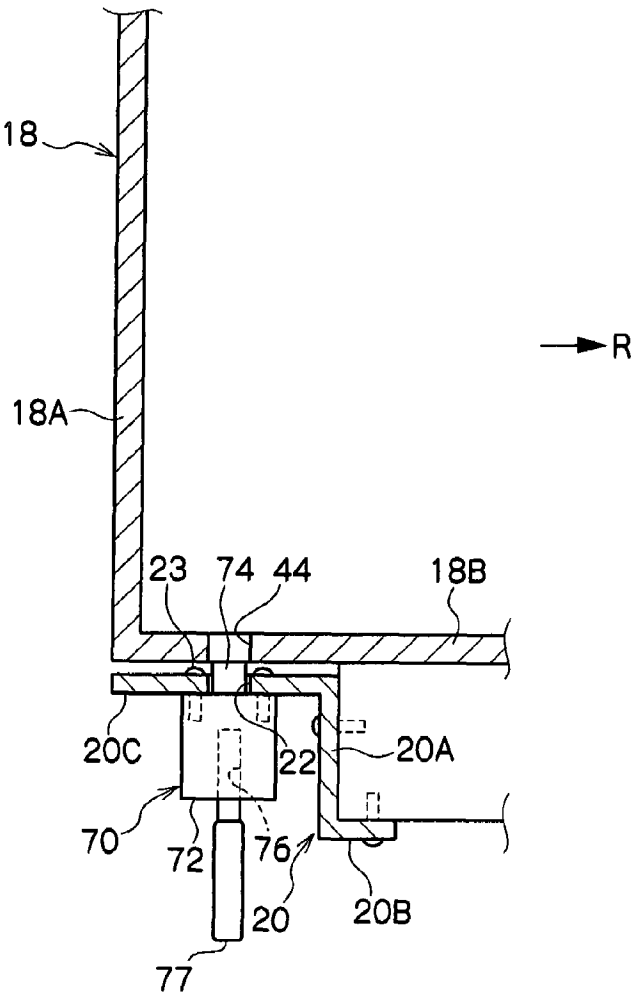

When pulling the sheet feed cassette 18 out from the main body frame 12 of the image forming device 10, as shown in FIG. 7A, the rod 74 of the lock 70 is in a state of being accommodated at the head portion 72. In this way, the sheet feed cassette 18 can be pulled out in the direction of arrow R from the main body frame 12, and recording sheets can be replenished into the sheet feed cassette 18, or work for eliminating a jam can be carried out, or the like.

On the other hand, as shown in FIG. 7B, at times such as when the image forming device 10 is not being driven or the like, due to rotational operation of the key 77, the rod 74 of the lock 70 is made to project-out from the head portion 72, and locks the sheet feed cassette 18 such that the sheet feed cassette 18 cannot be pulled out from the main body frame 12. Theft of the recording sheets within the sheet feed cassette 18 can thereby be prevented.

An image forming device 78 relating to a fourth exemplary embodiment of the present invention will be described next. Note that description of portions which are similar to the first exemplary embodiment will be omitted.

Figure 8:
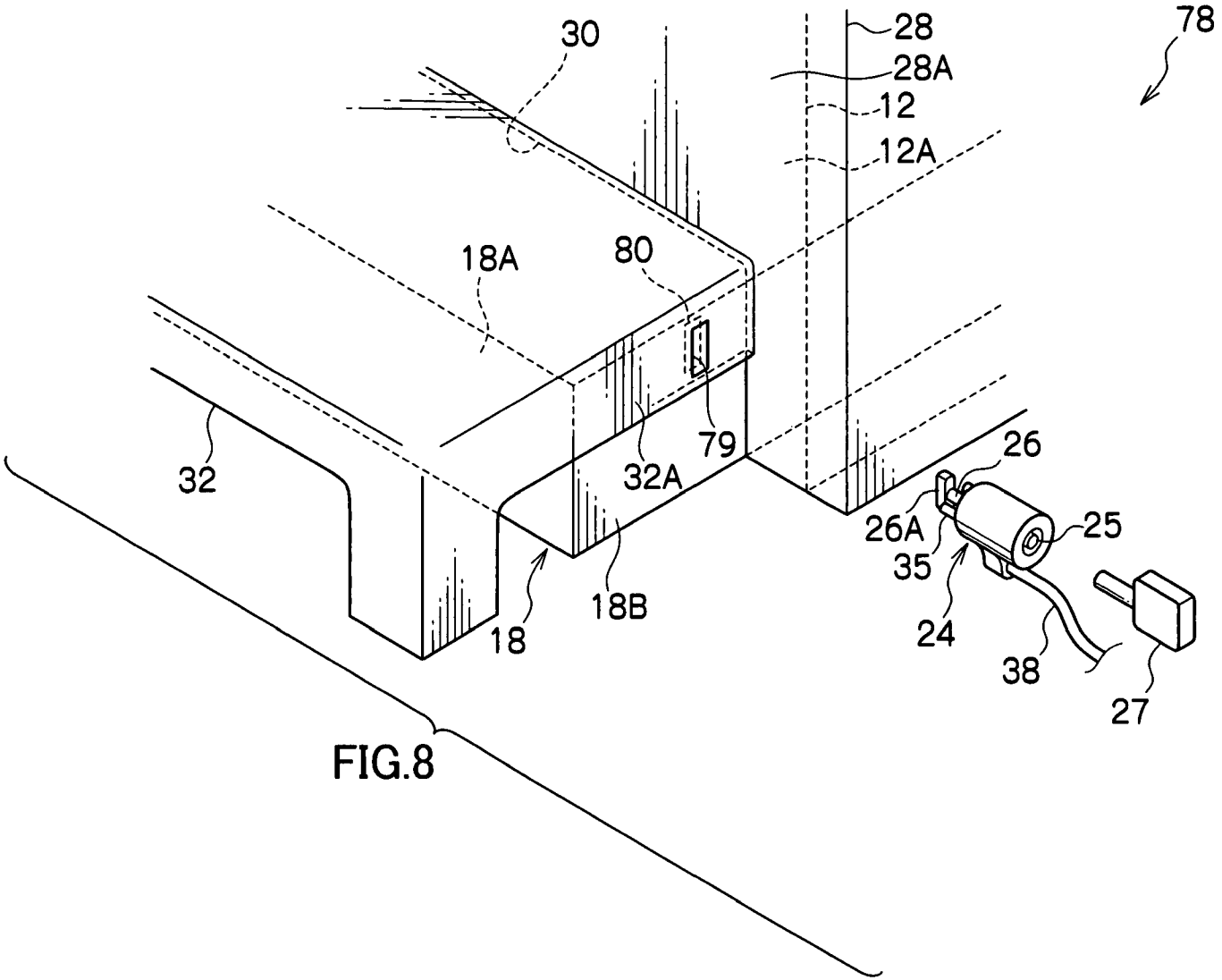
FIG. 8 is a perspective view viewing an image forming device of a fourth exemplary embodiment from the rear surface side thereof.

As shown in FIG. 8, a hole 79 is formed in a side wall 32A of the cover 32. The rod 26 of the lock 24 can be inserted through the hole 79.

On the other hand, a lock hole 80 is formed in the side wall 18B of the sheet feed cassette 18, at a position corresponding to the hole 79 which is formed in the hole of the cover 32. The rod 26 of the lock 24, which is inserted through the hole 79, can be inserted through the lock hole 80.

In accordance with this structure, when the rod 26 of the lock 24 is inserted through the lock hole 80, which is formed in the side wall 18B of the sheet feed cassette 18, and through the hole 79, which is formed in the side wall 32A of the cover 32, and the key 27 which is inserted in the keyhole 25 is rotated and the rod 26 is rotated, the hook 26A abuts the inner wall of the side wall 18B, and the rod 26 cannot be pulled out from the lock hole 80. In this way, the sheet feed cassette 18 is locked by the lock 24, and cannot be pulled out from the main body frame 12.

In this way, by attaching the lock 24 to the sheet feed cassette 18 and the cover 32 which is provided integrally with the main body cover 28, the sheet feed cassette 18 cannot be pulled out from the main body frame 12.

Because the sheet feed cassette 18 is locked to the cover 32 which is provided integrally with the main body cover 28, the sheet feed cassette 18 cannot be pulled out from the main body cover 28, and theft of the sheets can be prevented.

Because the sheet feed cassette 18 can be locked to the main body cover 28 (the cover 32 from which the sheet feed cassette 18 project) in this way without using a bracket or the like, the number of parts does not become greater than needed.

An image forming device 82 relating to a fifth exemplary embodiment of the present invention will be described next. Note that description of portions which are similar to the first exemplary embodiment will be omitted.

Figure 9:
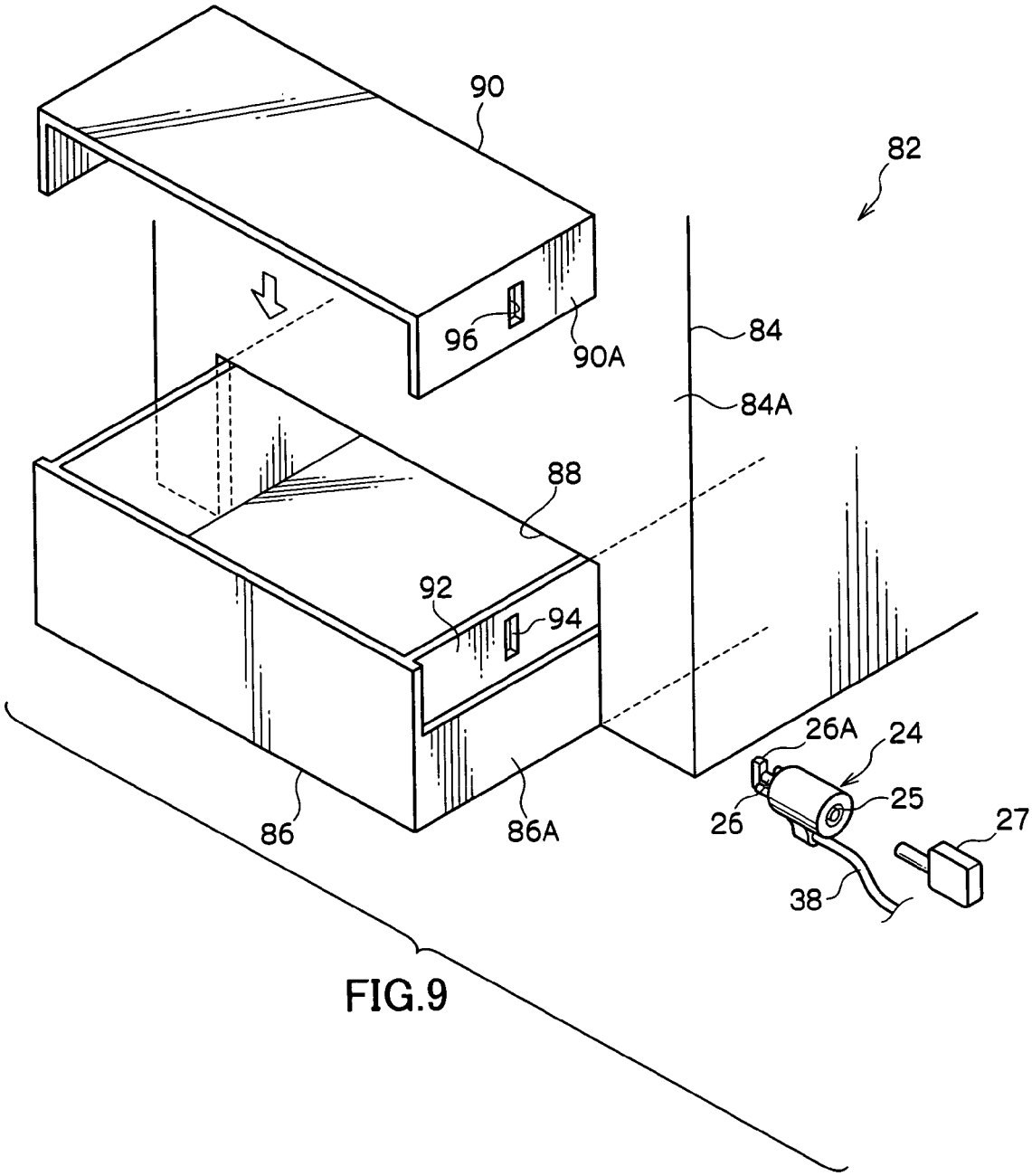
FIG. 9 is a perspective view viewing an image forming device of a fifth exemplary embodiment from the rear surface side thereof.
Figure 10:
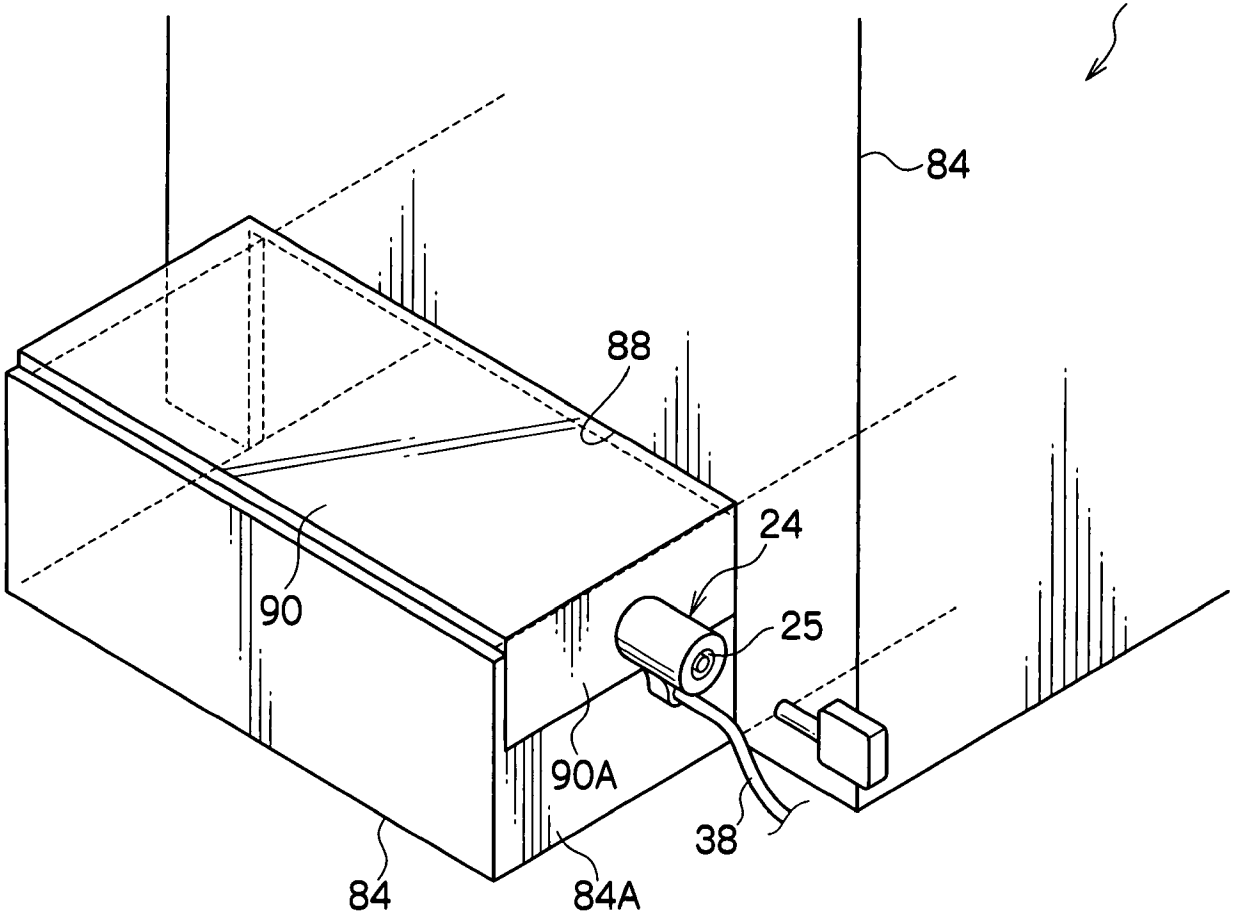
FIG. 10 is a perspective view viewing the image forming device of the fifth exemplary embodiment from the rear surface side thereof.

As shown in FIGS. 9 and 10, an opening 88, through which a sheet feed cassette 86 can be inserted, is formed in a rear surface 84A of a device main body 84. When the sheet feed cassette 86 is installed in the device main body 84, the back wall side of the sheet feed cassette 86 is exposed from the opening 88.

A cover 90 is attached to the portion of the sheet feed cassette 86 which portion is exposed from the opening 88. The cover 90 is formed in a substantial U-shape, and a side wall 90A thereof engages with a step portion 92 formed at a side wall 86A of the sheet feed cassette 86. In the state in which the cover 90 is attached to the sheet feed cassette 86, if an attempt is made to pull the sheet feed cassette 86 out from the device main body 84, the cover 90 catches on the opening 88, and pulling-out of the sheet feed cassette 86 is impeded.

Lock holes 94, 96 are formed in the step portion 92 formed at the side wall 86A of the sheet feed cassette 86, and in the side wall 90A of the cover 90, respectively. The rod 26 of the lock 24 can be inserted through the lock holes 94, 96.

In accordance with this structure, when the rod 26 of the lock 24 is inserted through the lock holes 94, 96 of the sheet feed cassette 86 and the cover 90, and the key 27 inserted in the keyhole 25 is rotated and the rod 26 is rotated, the hook 26A abuts the inner wall of the side wall 86A, and the lock 26 cannot be pulled out from the lock holes 94, 96. Because the cover 90 is locked to the sheet feed cassette 86 by the lock 24 in this way, the cover 90 cannot be opened and the sheets within the sheet feed cassette 86 cannot be removed therefrom.

By attaching the cover 90 to the sheet feed cassette 86 and attaching the lock 24 to the sheet feed cassette 86 and the cover 90 in this way, the sheet feed cassette 86 and the cover 90 are locked. Further, the sheet feed cassette 86 cannot be pulled out from the device main body 84, and theft of the sheets within the sheet feed cassette 86 is prevented.

An image forming device 150 relating to a sixth exemplary embodiment of the present invention will be described next. Note that description of portions which are similar to the first exemplary embodiment will be omitted.

Figure 11:
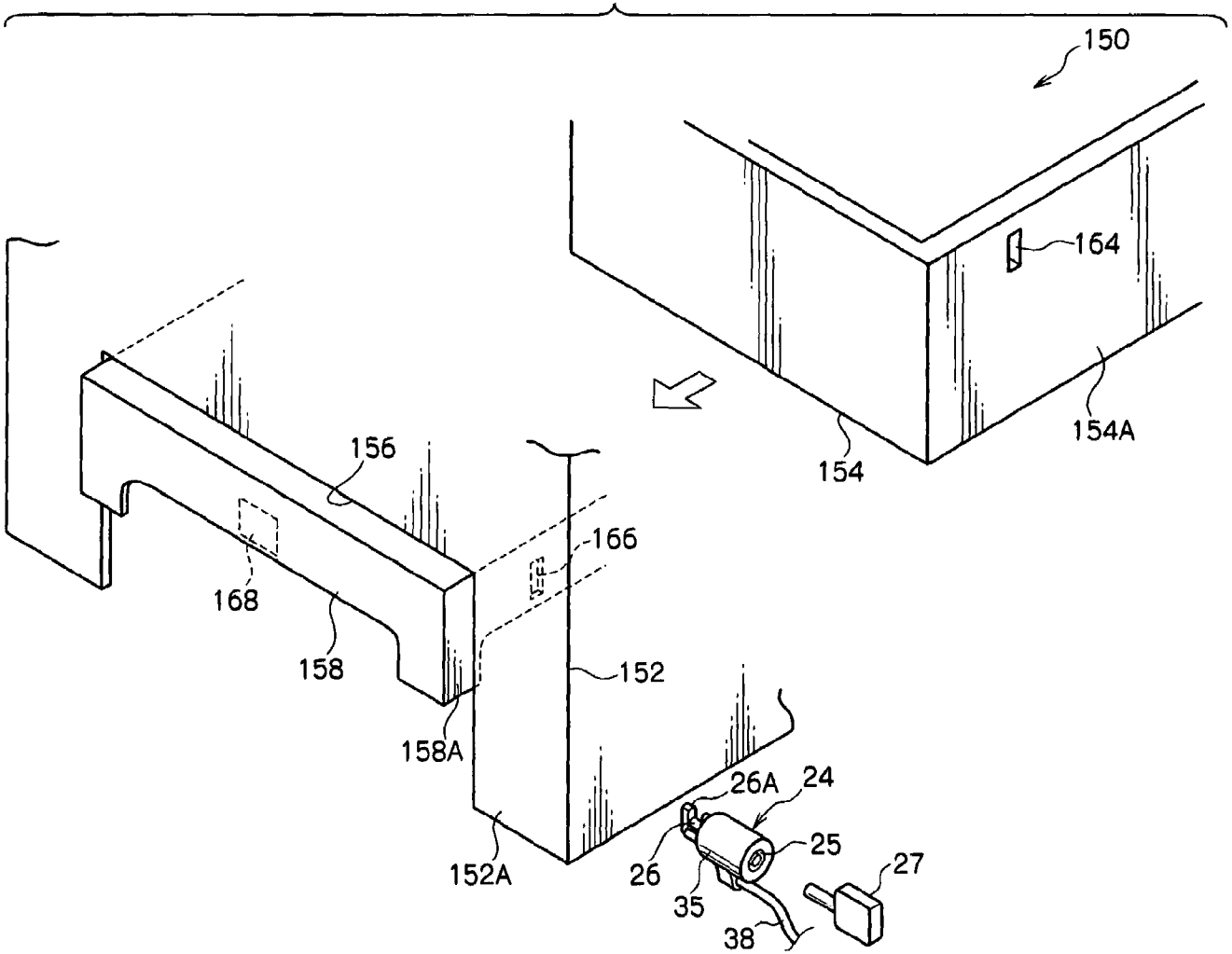
FIG. 11 is a perspective view viewing an image forming device of a sixth exemplary embodiment from the rear surface side thereof.
Figure 12:
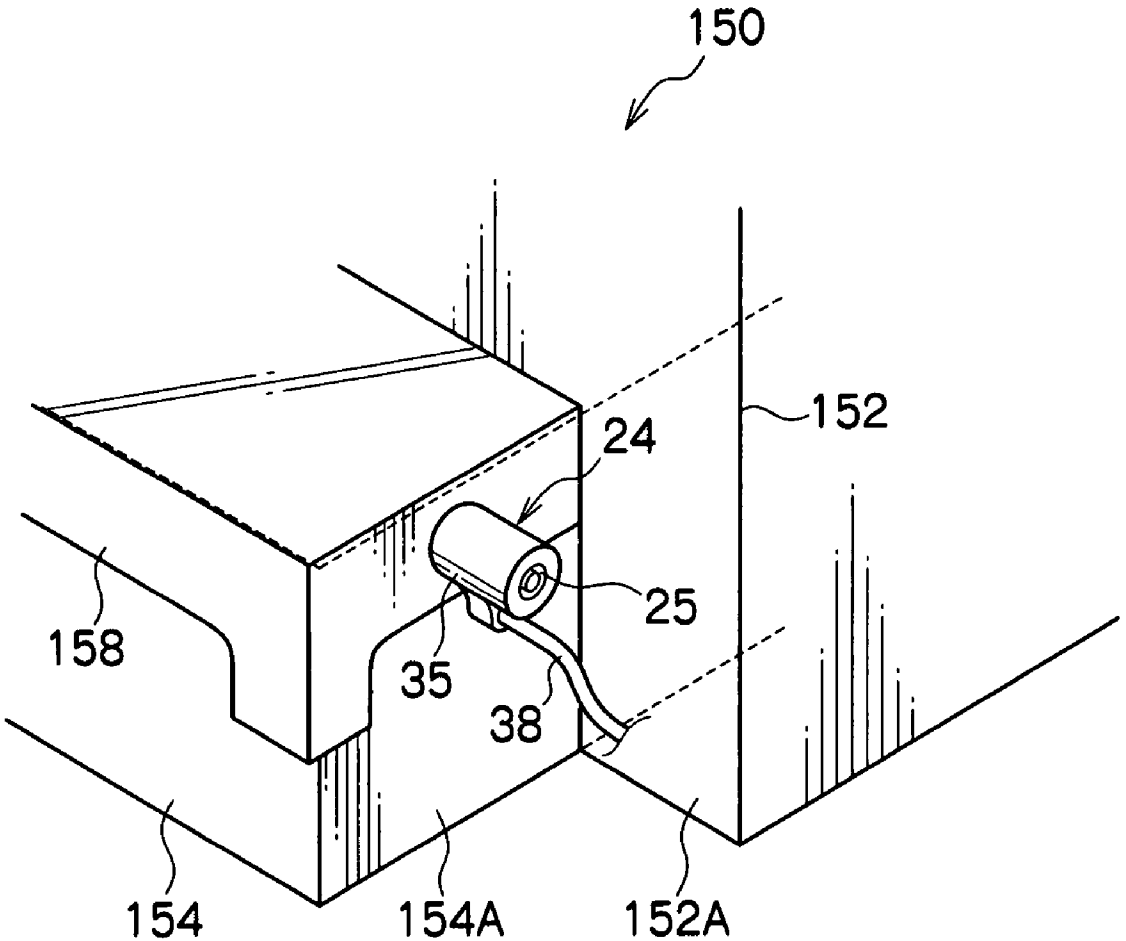
FIG. 12 is a perspective view viewing the image forming device of the sixth exemplary embodiment from the rear surface side thereof.

As shown in FIGS. 11 and 12, an opening 156, through which a sheet feed cassette 154 can be inserted, is formed in a rear surface 152A of a device main body 152. When the sheet feed cassette 154 is installed in the device main body 152, the back wall side of the sheet feed cassette 154 is exposed from the opening 156.

A rectangular-box-shaped cover 158 is provided within the device main body 152. The cover 158 can slide due to unillustrated guide rails along the direction of pulling-out the sheet feed cassette 154. In this way, when the sheet feed cassette 154 is installed in the device main body 152, as shown in FIG. 13B, the cover 158 is pushed by the sheet feed cassette 154 and is exposed from the opening 156 of the device main body 152.

As shown in FIG. 11, a magnet 168 is provided at the surface (reverse surface) of the cover 158 which surface opposes the back wall of the sheet feed cassette 154. When the sheet feed cassette 154 is installed in the device main body 152, the magnet 168 is attracted by the sheet feed cassette 154 which is formed of metal, and the reverse surface of the cover 158 and the back wall of the sheet feed cassette 154 are attracted together tightly. In this way, when the sheet feed cassette 152 is pulled out from the device main body 152, the cover 158 also moves in the direction of pulling-out the sheet feed cassette 154.

Figure 13A:
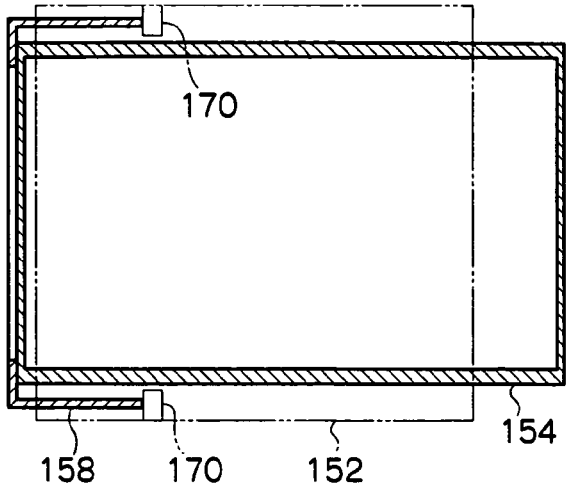
FIGS. 13A through 13C are top views of the image forming device of the sixth exemplary embodiment.
Figure 13B:
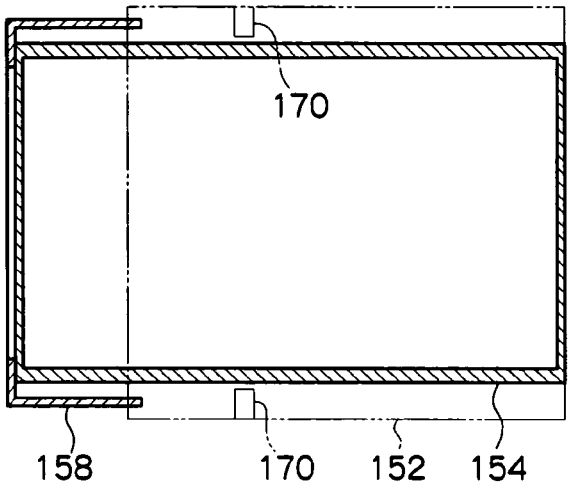
Figure 13C:
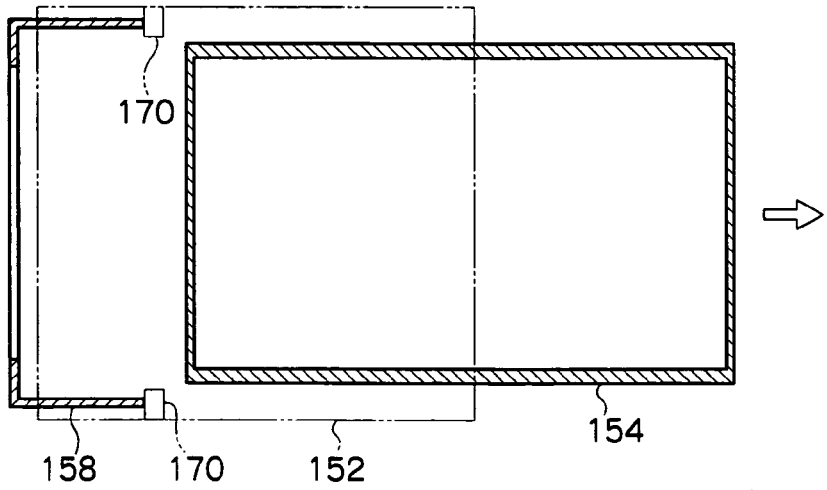

Further, as shown in FIG. 13A, stoppers 170 are provided at the inner side wall of the device main body 152. The stoppers 170 are provided at positions at which the end surface of the cover 158 abuts the stoppers 170, when the cover 158 is in the state of being accommodated within the device main body 152 (the state in which the cover 158 is not exposed from the opening 156 of the device main body 152). In this way, when the sheet feed cassette 154 is pulled out from the device main body 152 as shown in FIG. 13C, movement of the cover 158 in the pulling-out direction is impeded by the stoppers 170, and the cover 158 is not pulled out from the device main body 152 together with the sheet feed cassette 154.

As shown in FIGS. 11 and 12, lock holes 164, 166 are formed in a side wall 154A of the sheet feed cassette 154 and in a side wall 158A of the cover 158, respectively. The rod 26 of the lock 24 can be inserted through the lock holes 164, 166.

Figure 14A:
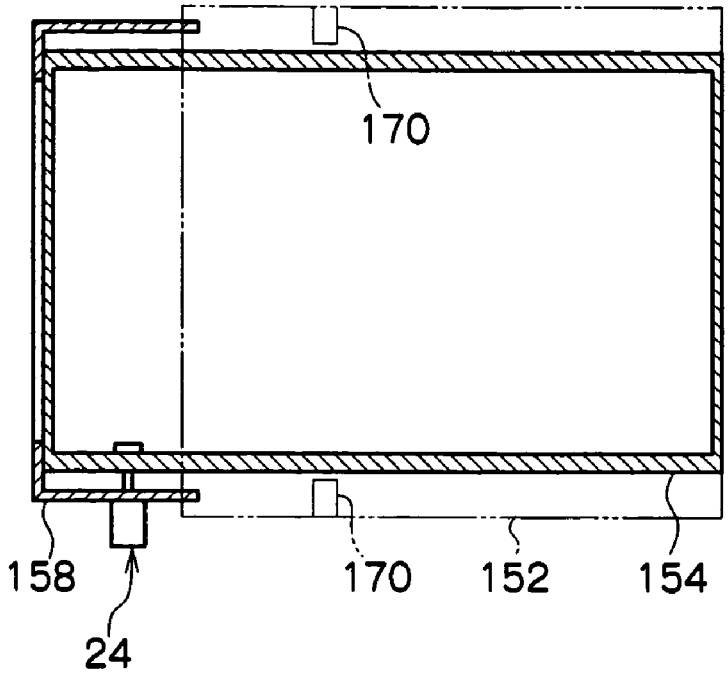
FIGS. 14A and 14B are top views of the image forming device of the sixth exemplary embodiment.

In accordance with this structure, when the rod 26 of the lock 24 is inserted-through the lock holes 164, 166 of the sheet feed cassette 154 and the cover 158, and the key 27 inserted in the keyhole 25 is rotated and the rod 26 is rotated, the hook 26A abuts the inner wall of the side wall 154A, and the rod 26 cannot be pulled out from the lock holes 164, 166. In this way, as shown in FIGS. 12 and 14A, the cover 158 is locked to the sheet feed cassette 154 by the lock 24. The cover 158 cannot be opened, and the sheets within the sheet feed cassette 154 cannot be removed.

Figure 14B:
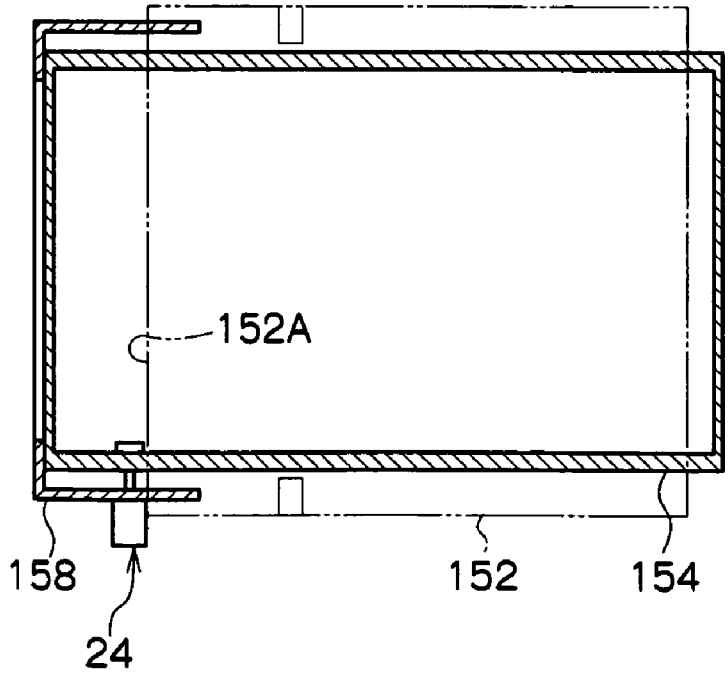

Further, if an attempt is made to pull the sheet feed cassette 154 out from the device main body 152, as shown in FIG. 14B, in the midst of the pulling-out of the sheet feed cassette 154, the lock 24 hits the rear surface 152A of the device main body 152, and pulling-out of the sheet feed cassette 154 is impeded. At this time, the interior of the sheet feed cassette 152 is exposed from the front side (the pull-out direction side) of the sheet feed cassette 154. However, because there is a sheet presser or the like at the front side within the sheet feed cassette 154, the sheets within the sheet feed cassette 154 cannot be removed from this slightly-exposed gap.

In this way, by attaching the lock 24 to the sheet feed cassette 154 and the cover 158 which is provided at the device main body 152, the sheet feed cassette 154 and the cover 158 are locked. Further, the sheet feed cassette 154 cannot be pulled out from the device main body 152, and theft of the sheets within the sheet feed cassette 154 is prevented.

The foregoing description of the embodiments of the present invention has been provided for the purpose of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to are suited to the particular use contemplated. It is intended that the scope of the invention be defined by the following claims and their equivalents.

What is claimed is:

1. An image forming device comprising:

a cassette that can be pulled out from a front surface of a device main body, and that accommodates a recording medium;

a cover provided so as to project out from a rear surface of the device main body, and covering the cassette that projects out from the rear surface of the device main body; and a lock unit locking the cover and the cassette, wherein the cover is removable from the rear surface when the lock unit is not locking the cover and the cassette.

2. The image forming device of claim 1, wherein the lock unit comprises:

a first lock hole formed in the cover;

a second lock hole formed in a peripheral wall of the cassette; and a lock having a rod, that passes through the first lock hole and is inserted in the second lock hole, and a hook, that is formed at the rod and that hooks on the second lock hole.

3. The image forming device of claim 2, wherein the lock unit further comprises a wire connecting the lock and a heavy object.

4. An image forming device comprising:

a cassette that can be pulled out from a front surface of a device main body, and that accommodates a recording medium;

a cover provided slidably at the device main body, and covering the cassette that projects out from a rear surface of the device main body;

an engaging unit that engages the cassette and the cover when the cassette is installed;

a stopper provided at the device main body, and impeding movement of the cover in a pulling-out direction; and a lock unit that locks the cover and the cassette, and that abuts the rear surface of the device main body when the cassette is pulled out.

5. The image forming device of claim 4, wherein the lock unit comprises:

a first lock hole formed in the cover;

a second lock hole formed in a peripheral wall of the cassette; and a lock having a rod, that passes through the first lock hole and is inserted in the second lock hole, and a hook, that is formed at the rod and that hooks on the second lock hole.

6. The image forming device of claim 4, wherein the lock unit further comprises a wire connecting the lock and a heavy object.

7. The image forming device of claim 4, wherein the engaging unit has a magnet, the cassette is formed of a metal, and the cassette is attracted by the magnet which is provided at the cover.

* * * * *